US009739471B1

(12) United States Patent
Chen

(10) Patent No.: US 9,739,471 B1
(45) Date of Patent: Aug. 22, 2017

(54) LED LAMP BULB

(71) Applicant: Tse Min Chen, Hsinchu (TW)

(72) Inventor: Tse Min Chen, Hsinchu (TW)

( * ) Notice: Subject to any disclaimer, the term of this patent is extended or adjusted under 35 U.S.C. 154(b) by 29 days.

(21) Appl. No.: 15/096,420

(22) Filed: Apr. 12, 2016

(51) Int. Cl.

| | |
|---|---|
| ***F21S 13/10*** | (2006.01) |
| ***F21V 31/00*** | (2006.01) |
| ***F21K 9/232*** | (2016.01) |
| ***F21K 9/237*** | (2016.01) |
| ***F21V 23/00*** | (2015.01) |
| *F21Y 115/10* | (2016.01) |

(52) U.S. Cl.
CPC ..... *F21V 31/00* (2013.01); *F21K 9/232* (2016.08); *F21K 9/237* (2016.08); *F21V 23/009* (2013.01); *F21Y 2115/10* (2016.08)

(58) Field of Classification Search
CPC ..... F21V 31/00; F21V 23/02; F21V 23/023; F21V 23/009; F21K 9/232; F21K 9/237; F21Y 2115/00; F21Y 2115/10
See application file for complete search history.

(56) References Cited

U.S. PATENT DOCUMENTS 4,352,043 A * 9/1982 Rigden ..... H01J 63/02 313/293
5,165,666 A * 11/1992 Gerencser ..... H01K 1/62 307/10.8
8,070,347 B1 * 12/2011 Lin ..... F21V 31/00 362/391
2010/0002432 A1 * 1/2010 Romano ..... F21S 48/328 362/235
2011/0133652 A1 * 6/2011 Chen ..... F21V 19/001 315/112
2011/0285308 A1 * 11/2011 Crystal ..... H05B 33/0815 315/287
2011/0316407 A1 * 12/2011 Lin ..... F21V 3/0436 313/46
2012/0091907 A1 * 4/2012 Setomoto ..... H05B 33/0815 315/200 R
2012/0187818 A1 * 7/2012 Chuang ..... F21V 29/83 313/46
2015/0036341 A1 * 2/2015 Ge ..... F21V 3/02 362/240

* cited by examiner

*Primary Examiner* — Ali Alavi
(74) *Attorney, Agent, or Firm* — Jackson IPG PLLC; Demian K. Jackson

(57) ABSTRACT

A LED lamp bulb includes an envelope having a tubular neck, a LED driver module mounted in the tubular neck of the envelope with a LED circuit assembly thereof suspending in the envelope and positive and negative lead wires thereof respectively extended to the outside of the envelope, a lamp head bonded to the outer peripheral wall of the tubular neck of the envelope with the center contact thereof electrically connected with the positive lead wire of the LED driver module and the ring contact thereof electrically connected with the negative lead wire of the LED driver module, and an adhesive bonding layer sealed in between the LED driver module and the inner peripheral wall of the tubular neck of the envelope in an airtight manner.

1 Claim, 5 Drawing Sheets

LED LAMP BULB

BACKGROUND OF THE INVENTION

1. Field of the Invention

The present invention relates to electric lamps and more particularly, to a LED lamp bulb, which provides a waterproof sealing effect, and allows bonding of the positive and negative lead wires of the LED driver module to the ring contact and center contact of the lamp head automatically using a conventional incandescent lamp bulb lead wire bonding technique, saving much labor and time, increasing productivity and significantly reducing the manufacturing cost.

2. Description of the Related Art

A conventional incandescent lamp bulb generally comprises a glass or quartz bulb filled with inert gas or evacuated, a wire filament suspended in the glass or quartz bulb, a lamp head fixedly connected with the glass or quartz bulb, and positive and negative conducting wires respectively and electrically connected between the two opposite ends of the wire filament and the ring contact and center contact of the lamp head. The installation of the lamp head in the glass or quartz bulb and the bonding between the positive and negative conducting wires and the ring contact and center contact of the lamp head can be achieved using an automatic bonding and assembly equipment.

Further, various LED lamp bulbs have been created to replace conventional incandescent lamp bulbs. A LED lamp bulb generally comprises an envelope, a lamp head, a LED driver module and a LED circuit assembly. This design of LED lamp bulb is still not satisfactory in function due to the drawbacks as follows:

1. The LED driver module and the envelope cannot be set in position steadily, and therefore, the bonding of the positive and negative lead wires cannot be achieved using a conventional automatic incandescent lamp bulb bonding and assembly equipment. Because the bonding of the positive and negative lead wires relies upon labor, the fabrication of the LED lamp bulb requires much labor and time, relatively increasing the manufacturing cost. If the negative lead wire is clamped between the envelope and the lamp head without bonding, there is a danger of disconnection of the lead wire. In order to facilitate implementation of an automatic bonding and assembly process, a complicated and expensive modification design will be necessary, however, due to high cost, this measure does not have a significant industrial value.
2. Water can leak through gaps between the LED driver module and the envelope to wet the internal circuit components of the LED lamp bulb, resulting in failure or short circuit and lowering the safety level.

SUMMARY OF THE INVENTION

The present invention has been accomplished under the circumstances in view. It is therefore the main object of the present invention to provide a LED lamp bulb, which comprises an envelope having a tubular neck, a LED driver module mounted in the tubular neck of the envelope with a LED circuit assembly thereof suspending in the envelope and positive and negative lead wires thereof respectively extended to the outside of the envelope, a lamp head bonded to the outer peripheral wall of the tubular neck of the envelope with the center contact thereof electrically connected with the positive lead wire of the LED driver module and the ring contact thereof electrically connected with the negative lead wire of the LED driver module, and an adhesive bonding layer sealed in between the LED driver module and the inner peripheral wall of the tubular neck of the envelope in an airtight manner. Therefore, the LED lamp bulb of the invention provides a waterproof sealing effect.

Further, because the LED driver module is fixedly bonded to the envelope in a watertight manner by the adhesive bonding layer, the positive and negative lead wires of the LED driver module can be bonded to the ring contact and center contact of the lamp head and checked automatically using a conventional incandescent lamp bulb lead wire bonding technique.

Further, assembling the LED lamp bulb can be done using an automatic assembly system, saving much labor and time, increasing productivity and significantly reducing the manufacturing cost.

DETAILED DESCRIPTION OF THE INVENTION

Figure 1:
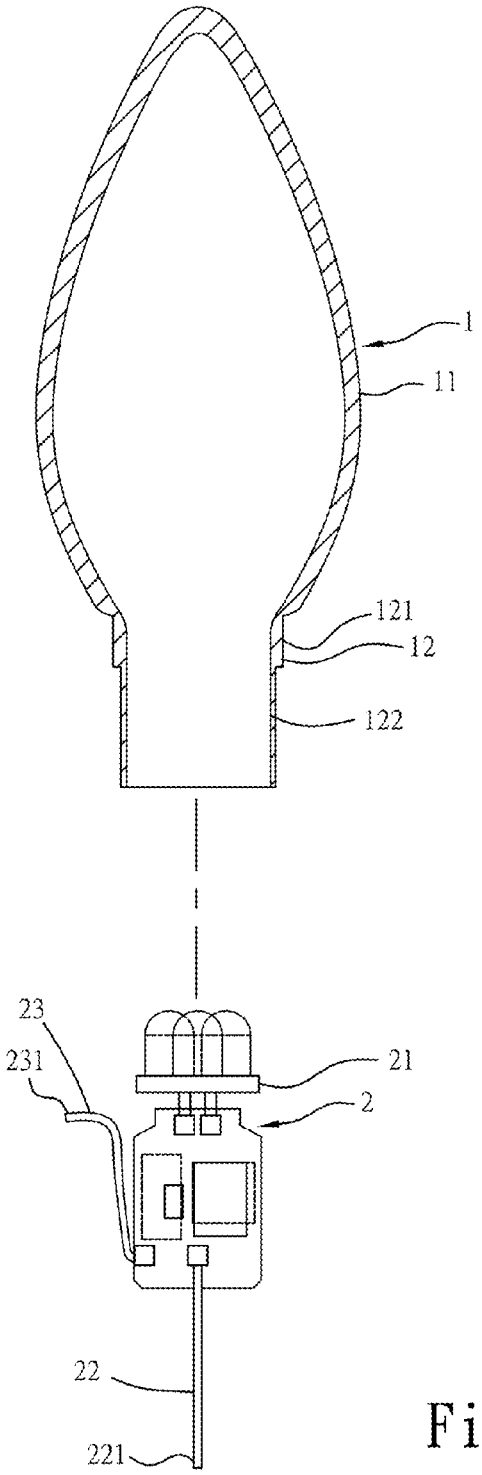
FIG. 1 is an exploded plain view of a part of a LED lamp bulb in accordance with the present invention, illustrating the relationship between a LED driver module and an envelope of the LED lamp bulb.
Figure 2:
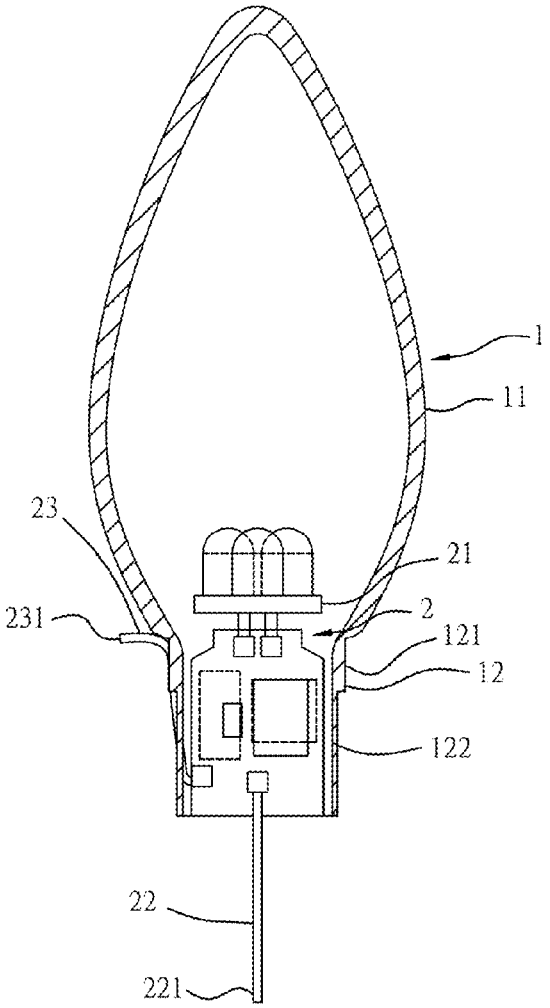
FIG. 2 corresponds to FIG. 1, illustrating the LED driver module mounted in the envelope before adhesive potting.
Figure 3:
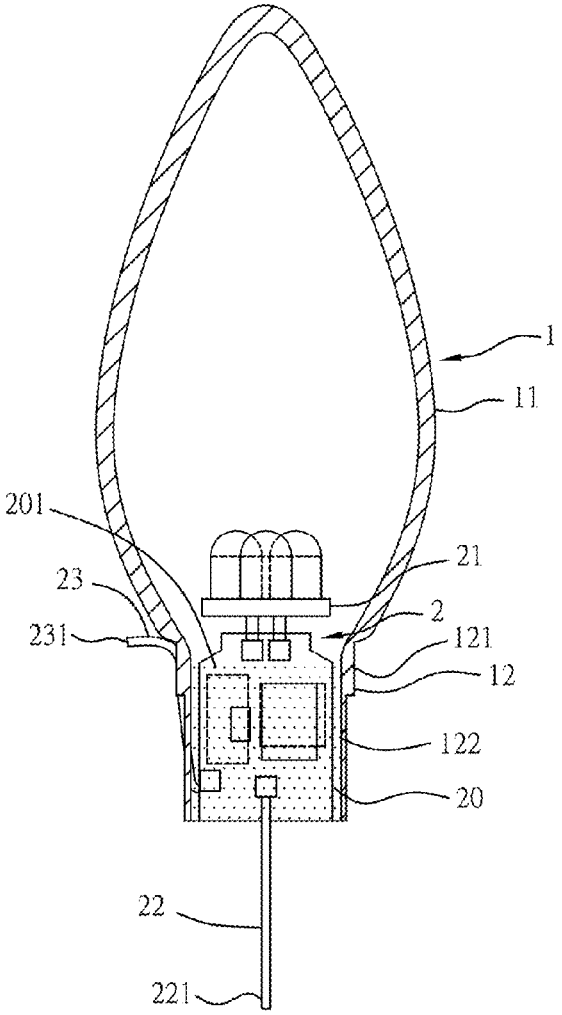
FIG. 3 corresponds to FIG. 2, illustrating the adhesive bonding layer formed between the LED driver module and the inner peripheral wall of the tubular neck of the envelope.
Figure 4:
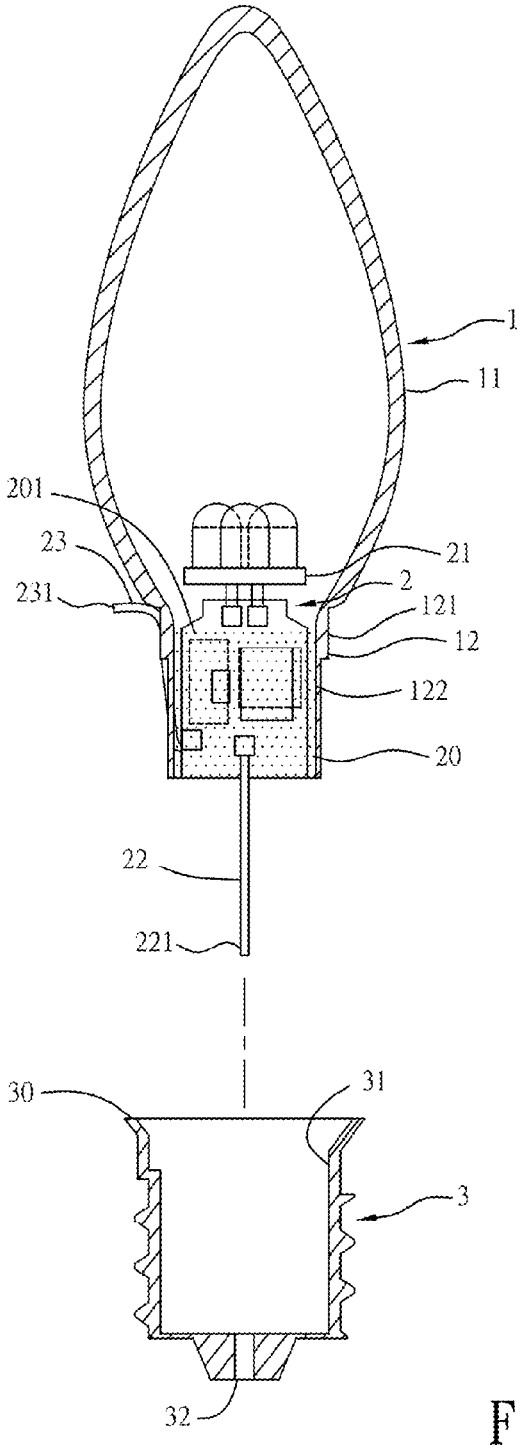
FIG. 4 is an exploded plain view of the present invention, illustrating the LED driver module installed in the tubular neck of the envelope before connection between the lamp head and the envelope.
Figure 5:
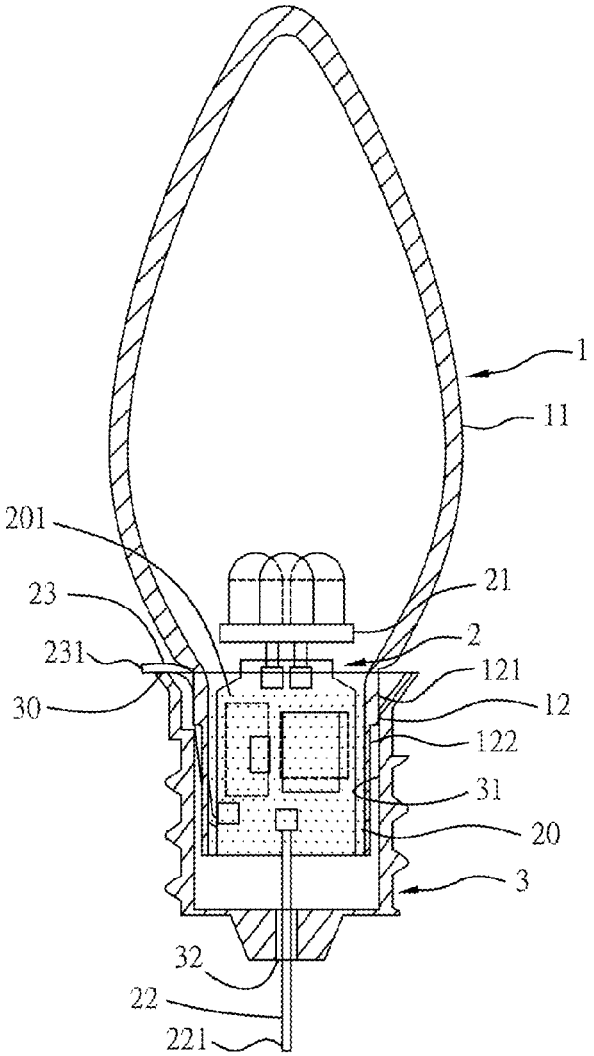
FIG. 5 is a sectional assembly view of the LED lamp bulb in accordance with the present invention.

Referring to FIGS. 1-5, a LED lamp bulb in accordance with the present invention is shown. The LED lamp bulb comprises:

an envelope 1 (see FIG. 1 and FIG. 2), comprising a hollow envelope body 11 and a tubular neck 12 extended from a bottom side of the hollow envelope body 11 in such a manner that the space inside the tubular neck 12 is kept in communication with the space inside the hollow envelope body 11, the tubular neck 12 defining an inner peripheral wall 122 for the connection of a LED driver module 2 and an opposing outer peripheral wall 121 for the bonding of a lamp head 3 (see FIG. 4 and FIG. 5);

a LED driver module 2 mounted in the tubular neck 12 of the envelope 1 (see FIG. 2) and sealed by an adhesive bonding layer 20 that adheres the LED driver module 2 to the tubular neck 12 of the envelope 1 and seals up the gap between the LED driver module 2 and the inner peripheral wall 122 of the tubular neck 12 of the envelope 1 in an airtight manner (see FIG. 3), a LED circuit assembly 21 extended out of a top side 201 of the adhesive bonding layer 20 and suspending in the envelope 1 and controllable to emit light, and a positive lead wire 22 and a negative lead wire 23 respectively extended out of the adhesive bonding layer 20 with one end 221 of the positive lead wire 22 and one end 231 of the negative lead wire 23 disposed outside the envelope 1; and a lamp head 3 having an inner peripheral wall 31 thereof bonded to the outer peripheral wall 121 of the tubular neck 12 of the envelope 1, a center contact 32 thereof (see FIG.

4 and FIG. 5) electrically bonded to the positive lead wire 22 of the LED driver module 2, and a top edge of a ring contact 30 thereof (see FIGS. 4 and 5) electrically bonded to the negative lead wire 23 of the LED driver module 2.

Further, the adhesive bonding layer 20 that adheres the LED driver module 2 to the tubular neck 12 of the envelope 1 and seals up the gap between the LED driver module 2 the inner peripheral wall 122 of the tubular neck 12 of the envelope 1 can be formed using a potting technique or injection molding technique In general, the LED lamp bulb of the present invention has the advantages and effects as follows:

1. The LED driver module 2 is bonded to the inner peripheral wall 122 of the tubular neck 12 of the envelope 1 tightly by the adhesive bonding layer 20, achieving a waterproof sealing effect.

2. Because the LED driver module 2 is bonded to the inner peripheral wall 122 of the tubular neck 12 of the envelope 1 tightly by the adhesive bonding layer 20, the positive lead wire 22 and negative lead wire 23 of the LED driver module 2 can be bonded to the ring contact 30 and center contact 32 of the lamp head 3 and checked automatically using a conventional incandescent lamp bulb lead wire bonding technique.

3. Assembling the LED lamp bulb can be done using an automatic assembly system, saving much labor and time, increasing productivity and significantly reducing the manufacturing cost.

What is claimed is:

1. A LED lamp bulb, comprising:

an envelope comprising a hollow envelope body and a tubular neck extended from a bottom side of said hollow envelope body in such a manner that the space inside said tubular neck is kept in communication with the space inside said hollow envelope body, said tubular neck defining an inner perimeter and an opposing outer perimeter;

a LED driver module mounted in said tubular neck of said envelope, said LED driver module comprising a LED circuit assembly suspending in said envelope and controllable to emit light, and a positive lead wire and a negative lead wire extended out of said envelope;

a lamp head bonded to said outer peripheral wall of said tubular neck of said envelope, said lamp head comprising a center contact electrically connected with said positive lead wire of said LED driver module and a ring contact electrically connected with said negative lead wire of said LED driver module;

wherein:

the LED lamp further comprises an adhesive bonding layer sealed in between said LED driver module and said inner peripheral wall of said tubular neck of said envelope in an airtight manner such that said LED circuit assembly of said LED driver module extends out of a top side of said adhesive bonding layer and suspends in said envelope; said positive lead wire and said negative lead wire of said LED driver module respectively extend out of said adhesive bonding layer and said envelope and respectively electrically bonded to said center contact and said ring contact of said lamp head.

* * * * *